US006625904B1

(12) United States Patent
Frederiksen et al.

(10) Patent No.: US 6,625,904 B1
(45) Date of Patent: Sep. 30, 2003

(54) FOOTWEAR SYSTEM

(76) Inventors: Ben G. Frederiksen, P.O. Box 1555, Huntington Beach, CA (US) 92647; Gayle Trenberth, 600 Pacific Coast Highway, #216, Seal Beach, CA (US) 90740

( * ) Notice: Subject to any disclaimer, the term of this patent is extended or adjusted under 35 U.S.C. 154(b) by 236 days.

(21) Appl. No.: 09/928,382

(22) Filed: Aug. 13, 2001

(51) Int. Cl.[7] ..... A43B 3/12
(52) U.S. Cl. ..... 36/11.5; 36/9 R; 36/9 A
(58) Field of Search ..... 36/11.5, 9 R, 9 A, 36/94, 31, 71

(56) References Cited

U.S. PATENT DOCUMENTS 3,143,812 A * 8/1964 Bittner ..... 36/44
4,030,212 A * 6/1977 Ito ..... 36/11.5
5,737,853 A * 4/1998 Smejkal ..... 36/11.5
6,226,893 B1 * 5/2001 Schlamp et al. ..... 36/11.5
6,298,580 B1 * 10/2001 Tadayon ..... 36/11.5

* cited by examiner

*Primary Examiner*—Mickey Yu
*Assistant Examiner*—Troy Arnold
(74) *Attorney, Agent, or Firm*—Edward P. Dutkiewicz

(57) ABSTRACT

A footwear system having an essentially oblong platform formed of an elastomeric material having a first aperture offset from a long axis of the platform adjacent to a forward end. A U-shaped cut through a rearward end of the platform forms a first strap disposed toward the forward end with a second aperture through a midpoint of the first strap and aligned with the first aperture. A fastening member passes through the first and second apertures coupling the first strap and the platform and thereby forming two separate passageways. A second strap formed of an elastic material has a first attachment element coupling a forward end of the second strap and the platform adjacent to the fastening member. A second attachment element couples a rearward end of the second strap and the platform adjacent to a lateral edge of the platform.

5 Claims, 4 Drawing Sheets

FIG 1
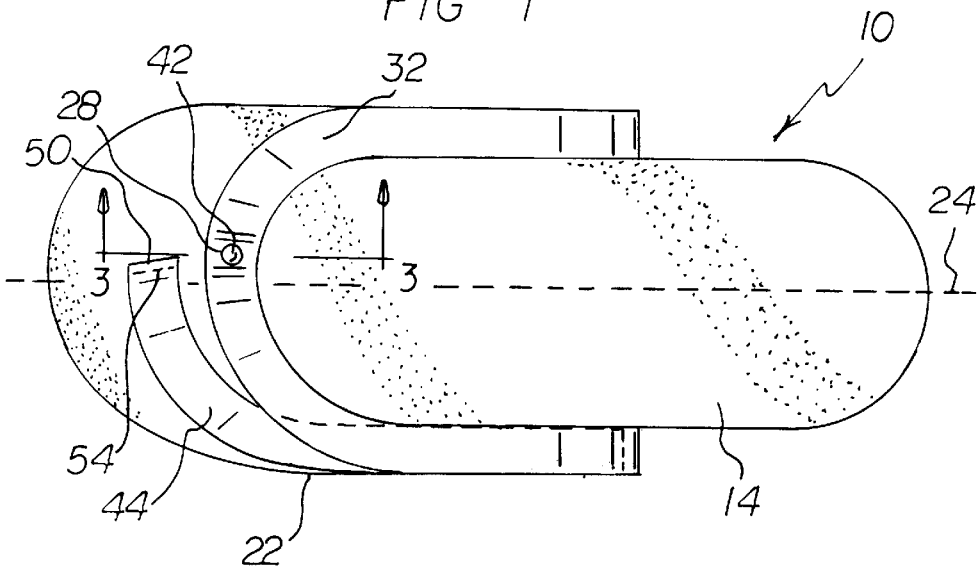
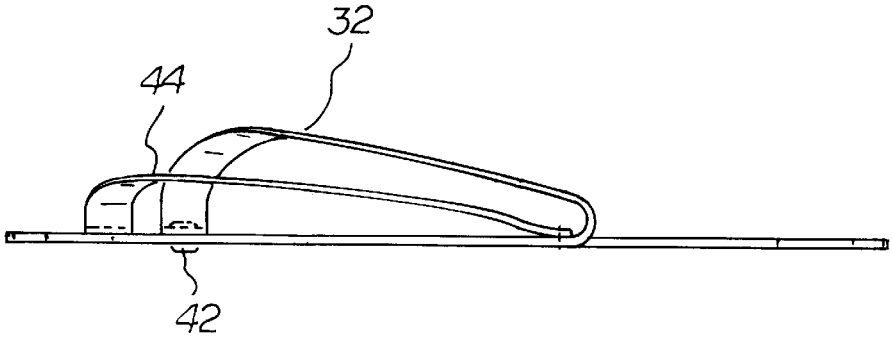
FIG 2

FIG 3
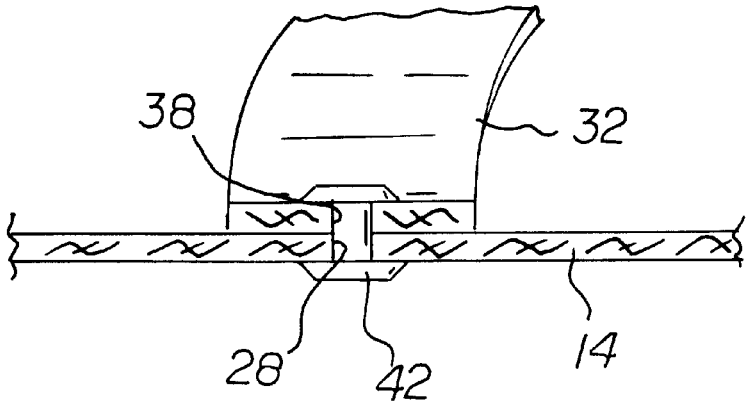
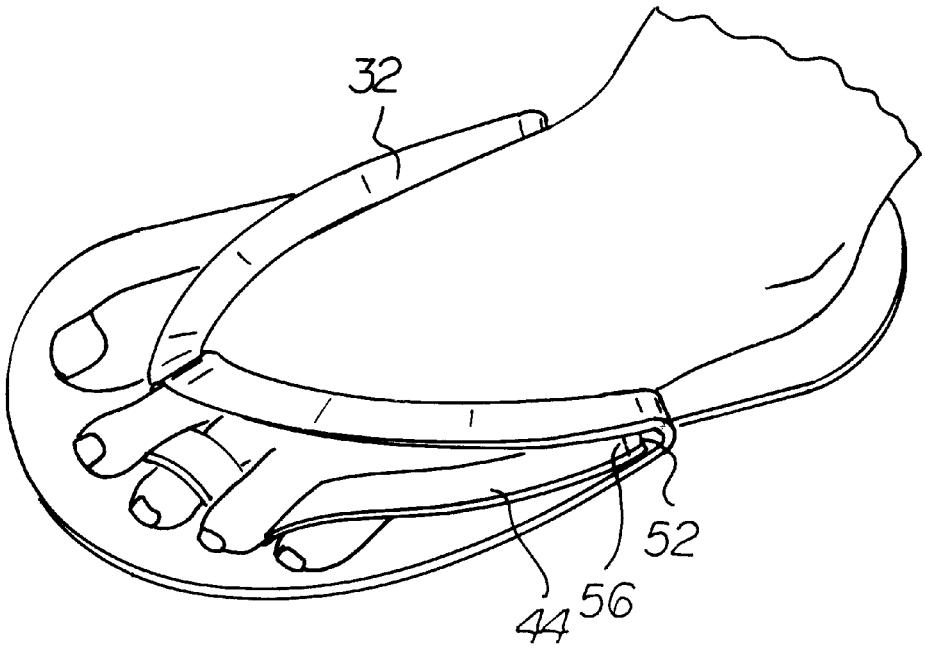
FIG 4

FIG 6
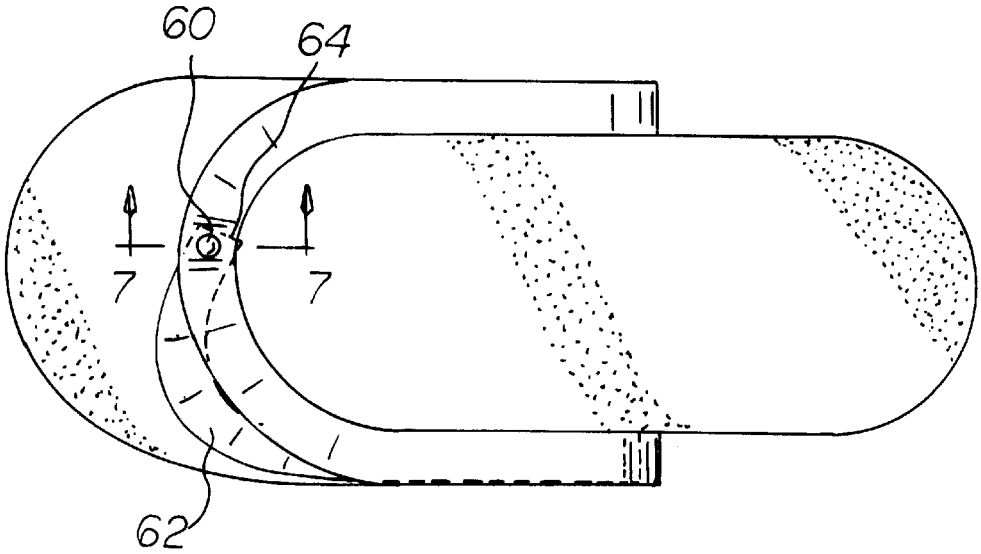
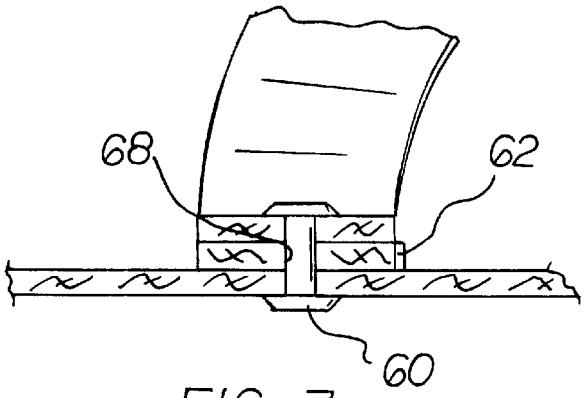
FIG 7

FOOTWEAR SYSTEM

BACKGROUND OF THE INVENTION

1. Field of the Invention

The present invention relates to a footwear system and more particularly pertains to protecting a wearer's foot by retaining the footwear in place in a safe comfortable and convenient manner.

2. Description of the Prior Art

The use of shoes, sandals and other footwear of known designs and configurations is known in the prior art. More specifically, shoes, sandals and other footwear of known designs and configurations previously devised and utilized for the purpose of rendering footwear safer or more comfortable through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,867,679 to Riehle et al discloses a foot corrective sandal. U.S. Pat. No. 2,751,693 to Baker discloses a toe spacing sandal. U.S. Pat. No. 5,802,737 to Beppu discloses a thong type sandal. Lastly, U.S. Pat. No. 5,870,837 discloses a combination pedicure.

While these devices fulfill their respective, particular objectives and requirements, the aforementioned patents do not describe a footwear system that allows protecting a wearer's foot by retaining the footwear in place in a safe comfortable and convenient manner.

In this respect, the footwear system according to the present invention substantially departs from the conventional concepts and designs of the prior art, and in doing so provides an apparatus primarily developed for the purpose of protecting a wearer's foot by retaining the footwear in place in a safe comfortable and convenient manner.

Therefore, it can be appreciated that there exists a continuing need for a new and improved footwear system which can be used for protecting a wearer's foot by retaining the footwear in place in a safe comfortable and convenient manner. In this regard, the present invention substantially fulfills this need.

SUMMARY OF THE INVENTION

In view of the foregoing disadvantages inherent in the known types of shoes, sandals and other footwear of known designs and configurations now present in the prior art, the present invention provides an improved footwear system. As such, the general purpose of the present invention, which will be described subsequently in greater detail, is to provide a new and improved footwear system and method which has all the advantages of the prior art and none of the disadvantages.

To attain this, the present invention essentially comprises an essentially oblong platform. The platform is formed of an elastomeric material. The platform may be fabricated of a biodegradable bio-plastic. The platform has a first aperture offset from a long axis of the platform adjacent to a forward end. A U-shaped cut is provided through a rearward end of the platform. The U-shaped cut forms a first strap. The first strap is disposed toward a forward end of the platform. A second aperture is formed through a midpoint of the first strap and is aligned with the first aperture. Next provided is a fastening member. The fastening member may be a rivet, or any other form of fastener, including stitching. The fastening member passes through the first and second apertures coupling the first strap and the platform. In this manner two separate passageways are formed. Lastly provided is a second strap. The second strap is formed of an elastic material and has a tensile strength different from the first strap. The second strap has a forward end and a rearward end. A first attachment stitch couples the forward end of the second strap and the platform adjacent to the fastening member but forwardly thereof. A second attachment stitch is provided. The second attachment stitch couples the rearward end of the second strap and the platform adjacent to a lateral edge of the platform. In this manner a user may place the fifth, fourth, third and second toes on alternate surfaces of the second strap in a serpentine orientation. The toes are then separated and convenient access is provided to the toes and toenails of the user's foot for pedicure operations such as painting the user's toenails. Following the pedicure, the sandal may be worn by the user. It provides a safe and sturdy walking surface and protects the toes and toenails until it is later disposed of, either at a spa where the pedicure services are rendered, or later at the home of the user should they wish to protect the toes and toenails for a longer period of time.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved footwear system which has all of the advantages of the prior art shoes, sandals and other footwear of known designs and configurations and none of the disadvantages.

It is another object of the present invention to provide a new and improved footwear system which may be easily and efficiently manufactured and marketed.

It is further an object of the present invention to provide a new and improved footwear system which is of durable and reliable constructions.

An even further object of the present invention is to provide a new and improved footwear system which is susceptible of a low cost of manufacture with regard to both materials and labor, and which accordingly is then susceptible of low prices of sale to the consuming public, thereby making such footwear system economically available to the buying public.

Even still another object of the present invention is to provide a footwear system for protecting a wearer's foot by retaining the footwear in place in a safe comfortable and convenient manner.

Lastly, it is an object of the present invention to provide a new and improved footwear system comprising an essentially oblong platform formed of an elastomeric material having a first aperture offset from a long axis of the platform adjacent to a forward end. A U-shaped cut through a rearward end of the platform forms a first strap disposed toward the forward end with a second aperture through a midpoint of the first strap and aligned with the first aperture. A fastening member passes through the first and second apertures coupling the first strap and the platform and thereby forming two separate passageways. A second strap formed of an elastic material has a first attachment means coupling a forward end of the second strap and the platform adjacent to the fastening member. A second attachment means couples a rearward end of the second strap and the platform adjacent to a lateral edge of the platform.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top elevational view of the new and improved footwear system constructed in accordance with the principles of the present invention.

FIG. 2 is a side elevational view of the footwear system shown in FIG. 1.

FIG. 3 is a cross-sectional view taken along line 3—3 of FIG. 1.

FIG. 4 is a perspective illustration of the sandal receiving a wearer's foot.

FIG. 6 is a top elevational view similar to FIG. 1 but illustrating an alternate embodiment of the invention.

FIG. 7 is a cross-sectional view taken alone line 7—7 of FIG. 6.

The same reference numerals refer to the same parts throughout the various Figures.

DESCRIPTION OF THE PREFERRED EMBODIMENT

Figure 5:
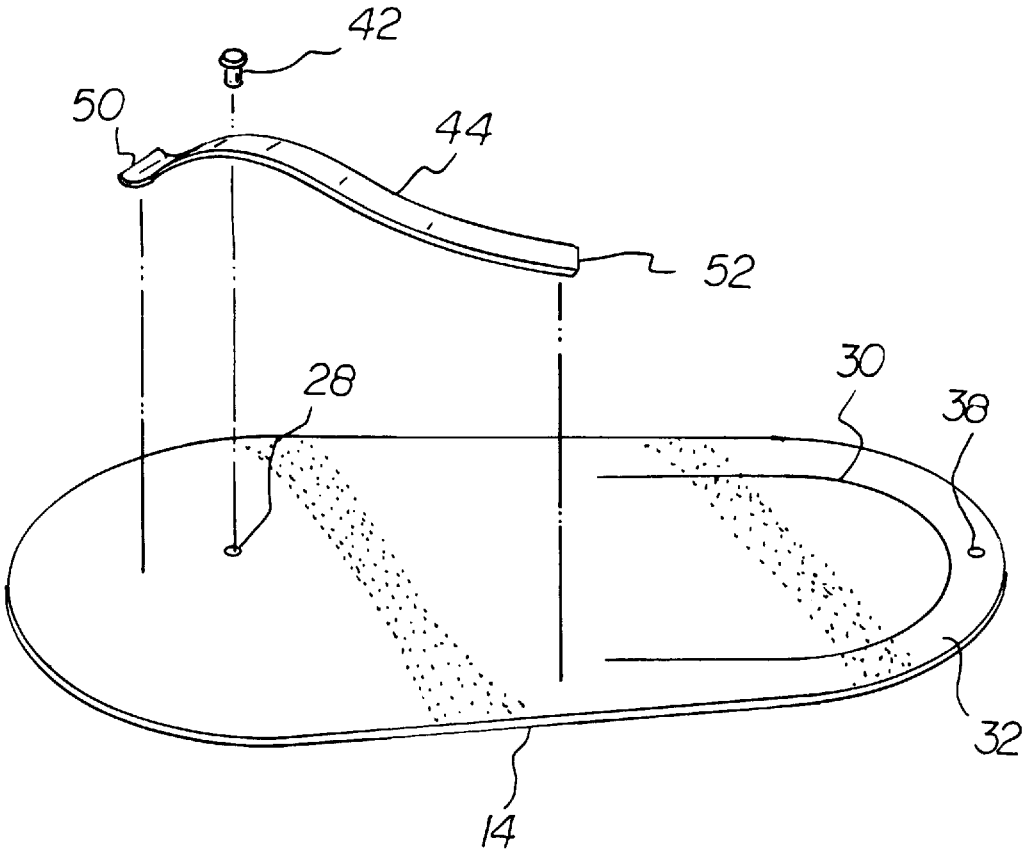
FIG. 5 is an exploded perspective view of the footwear system shown in the prior figures.

With reference now to the drawings, and in particular to FIG. 1 thereof, the preferred embodiment of the new and improved footwear system embodying the principles and concepts of the present invention and generally designated by the reference numeral 10 will be described.

The present invention, the footwear system 10 is comprised of a plurality of components. Such components in their broadest context include a platform, a fastening member, and a second strap. Such components are individually configured and correlated with respect to each other so as to attain the desired objective.

First provided is an essentially oblong platform 14. The platform is formed of an elastomeric material. The platform may be fabricated of a biodegradable bio-plastic. The platform has a first aperture 28 offset from a long axis 24 of the platform adjacent to a forward end. A U-shaped cut is provided 30 through a rearward end of the platform. The U-shaped cut forms a first strap 32. The first strap is disposed toward a forward end of the platform. A second aperture 38 is formed through a midpoint of the first strap and is aligned with the first aperture.

Next provided is a fastening member 42. The fastening member may be a rivet 60, or any other form of fastener, including stitching. The fastening member passes through the first and second apertures coupling the first strap and the platform. In this manner two separate passageways are formed.

Lastly provided is a second strap 44. The second strap is formed of an elastic material and has a tensile strength different from the first strap. The second strap has a forward end 50 and a rearward end 52. A first attachment stitch a54 couples the forward end of the second strap and the platform adjacent to the fastening member but forwardly thereof. A second attachment stitch 56 is provided. The second attachment stitch couples the rearward end of the second strap and the platform adjacent to a lateral edge of the platform. In this manner a user may place the fifth, fourth, third and second toes on alternate surfaces of the second strap in a serpentine orientation. The toes are then separated and convenient access is provided to the toes and toenails of the user's foot for pedicure operations such as painting the user's toenails.

In alternate embodiment of the present invention, the first attachment means of the second strap 62 is a third aperture 68 adjacent to the forward end 64. The fastening member passes through the first, second, and third apertures thereby coupling the first strap, the second strap and the platform.

The whole concept is a spa sandal that can be converted to a pedicure sandal. It is inexpensive enough that spas and salons can give it away to their customers. It can be worn as a spa sandal, a thong sandal with two straps on one side, and one strap on another side of the foot. If using it for a pedicure, the second strap can be woven between the other toes to separate them. Spas and salons can pass the sandal out to their clients when they enter the spa. The clients wear the spa sandal walking around the spa, use the pedicure strap when getting the pedicure. While disposable, the sandal will be sturdy enough for the client to be able to walk out of the spa after a pedicure, do a few chores, take the sandal off after 2 hours, when the toenails are really dry, and then dispose of the sandal. In an alternate embodiment the platform may be formed of a biodegradable material.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A footwear system for protecting a wearer's foot during and following pedicure operations by retaining the foot in place in a safe, comfortable and convenient manner, comprising, in combination:

an essentially oblong platform formed of an elastomeric material having a first aperture offset from a long axis of the platform adjacent to a forward end, a U-shaped cut through a rearward end of the platform forming a first strap disposed toward the forward end with a second aperture through a midpoint of the first strap and aligned with the first aperture, a fastening member passing through the first and second apertures coupling the first strap and the platform and thereby forming two separate passageways, a second strap formed of an elastic material, with a tensile strength different from the first strap and with a forward end and a rearward end, and with a first attachment stitch coupling the forward end of the second strap and the platform adjacent to the fastening member but forwardly thereof, and with a second attachment stitch coupling the rearward end of the second strap and the platform adjacent to a lateral edge thereby enabling a user to place the fifth, fourth, third and second toes on alternate surfaces of the second strap in a serpentine orientation to separate and allow convenient access to the toenails of the user's foot for pedicure operations such as painting the user's toenails.

2. A footwear system comprising:

an essentially oblong platform formed of an elastomeric material having a first aperture offset from a long axis of the platform adjacent to a forward end, a U-shaped cut through a rearward end of the platform forming a first strap disposed toward the forward end with a second aperture through a midpoint of the first strap and aligned with the first aperture, a fastening member passing through the first and second apertures coupling the first strap and the platform and thereby forming two separate passageways, a second strap formed of an elastic material with a first attachment means coupling a forward end of the second strap and the platform adjacent to the fastening member and with a second attachment means coupling a rearward end of the second strap and the platform adjacent to a lateral edge of the platform.

3. The system as set forth in claim 2 wherein the first attachment means of the second strap is a third aperture adjacent to the forward end and wherein the fastening member passes through the first, second, and third apertures coupling the first strap, the second strap and the platform.

4. The system as set forth in claim 2 wherein the platform is fabricated of a biodegradable bio-plastic.

5. The system as set forth in claim 2 wherein the fastening member is a rivet.

* * * * *